US010942010B1

(12) United States Patent
Martin et al.

(10) Patent No.: US 10,942,010 B1
(45) Date of Patent: Mar. 9, 2021

(54) ARCHITECTED ARMOR

(71) Applicant: HRL LABORATORIES, LLC, Malibu, CA (US)

(72) Inventors: John H. Martin, Malibu, CA (US); Brennon D. Yahata, Malibu, CA (US); Robert W. Cumberland, Malibu, CA (US); Jacob M. Hundley, Malibu, CA (US); Robert Mone, Malibu, CA (US); Eric C. Clough, Santa Monica, CA (US)

(73) Assignee: HRL Laboratories, LLC, Malibu, CA (US)

( * ) Notice: Subject to any disclaimer, the term of this patent is extended or adjusted under 35 U.S.C. 154(b) by 70 days.

(21) Appl. No.: 15/987,830

(22) Filed: May 23, 2018

Related U.S. Application Data

(60) Provisional application No. 62/537,845, filed on Jul. 27, 2017.

(51) Int. Cl.
*F41H 5/04* (2006.01)

(52) U.S. Cl.
CPC ..... *F41H 5/0492* (2013.01); *F41H 5/0421* (2013.01)

(58) Field of Classification Search
CPC .... F41H 5/0492; F41H 5/0421; F41H 5/0442; F41H 5/0414
USPC ..... 89/36.02
See application file for complete search history.

(56) References Cited

U.S. PATENT DOCUMENTS

| | | | | |
|---|---|---|---|---|
| 1,149,127 | A * | 8/1915 | Giem | F41A 23/34 89/40.03 |
| 3,705,558 | A | 12/1972 | Mcdougal et al. | |
| 5,654,518 | A * | 8/1997 | Dobbs | B64D 7/00 109/49.5 |
| 7,117,780 | B2 | 10/2006 | Cohen | |
| 7,382,959 | B1 * | 6/2008 | Jacobsen | B82Y 20/00 385/129 |
| 7,687,132 | B1 * | 3/2010 | Gross | B22F 1/0007 385/129 |
| 8,155,496 | B1 * | 4/2012 | Cumberland | F41H 5/0414 385/147 |
| 8,365,649 | B1 * | 2/2013 | Andrews | F41H 7/042 428/911 |
| 8,465,825 | B1 * | 6/2013 | Cumberland | F16D 65/12 165/DIG. 533 |
| 9,086,229 | B1 * | 7/2015 | Roper | G02B 5/08 |
| 9,229,162 | B1 * | 1/2016 | Roper | G02B 6/1221 |
| 9,546,826 | B1 * | 1/2017 | Carter | H01L 23/427 |
| 9,758,382 | B1 * | 9/2017 | Roper | C23C 16/01 |
| 9,921,037 | B2 * | 3/2018 | Wadley | B32B 5/02 |
| 9,933,213 | B1 * | 4/2018 | Jacobsen | F28D 20/023 |

(Continued)

*Primary Examiner* — Joshua E Freeman
*Assistant Examiner* — Bridget A Cochran
(74) *Attorney, Agent, or Firm* — Lewis Roca Rothgerber Christie, LLP

(57) ABSTRACT

According to an embodiment of the present invention, a three-dimensional architected armor structure includes a core structure and a matrix. The core structure includes: a plurality of impact members; a plurality of joint members below the impact members; and a plurality of connection members respectively extending between one of the impact members and one of the joint members. The matrix fills at least a portion of a space between the impact members, the joint members, and the connection members.

19 Claims, 11 Drawing Sheets

(56) References Cited

U.S. PATENT DOCUMENTS 10,323,909 B2 * 6/2019 Carton ..... F41H 7/042
10,378,861 B2 * 8/2019 Wadley ..... F41H 7/042
10,384,394 B2 * 8/2019 McCluskey ..... B29C 71/02
2005/0202206 A1 * 9/2005 Wadley ..... E04C 2/3405 428/116
2005/0217471 A1 * 10/2005 Benitsch ..... F41H 5/0414 89/36.02
2006/0048640 A1 * 3/2006 Terry ..... F41H 5/0414 89/36.02
2006/0080835 A1 * 4/2006 Kooistra ..... E04C 2/3405 29/897.34
2007/0234896 A1 * 10/2007 Joynt ..... F41H 7/042 89/36.09
2008/0226870 A1 * 9/2008 Sypeck ..... B32B 5/26 428/137
2009/0282773 A1 * 11/2009 Queheillalt ..... B21C 29/02 52/690
2010/0159294 A1 * 6/2010 Fly ..... B29C 67/20 429/483
2010/0300669 A1 * 12/2010 Jacobsen ..... F28F 13/003 165/185
2011/0111954 A1 * 5/2011 Li ..... B82Y 30/00 502/406
2011/0229685 A1 * 9/2011 Lin ..... B32B 3/12 428/117
2011/0283873 A1 * 11/2011 Wadley ..... F41H 5/023 89/36.02
2011/0314999 A1 * 12/2011 Luther ..... F41H 7/042 89/36.02
2012/0180632 A1 * 7/2012 Hunn ..... F41H 7/042 89/36.02
2013/0014635 A1 * 1/2013 Kosheleff ..... F41H 7/042 89/36.02
2013/0123935 A1 * 5/2013 Hunt ..... A61F 2/28 623/23.61
2013/0312595 A1 * 11/2013 Lee ..... F41H 7/042 89/36.02
2014/0060300 A1 * 3/2014 Kucherov ..... F41H 5/02 89/36.02
2014/0311330 A1 * 10/2014 Parida ..... F41H 7/042 89/36.08

* cited by examiner

ARCHITECTED ARMOR

CROSS-REFERENCE TO RELATED APPLICATIONS

This application claims priority to and the benefit of U.S. Provisional Patent Application No. 62/537,845, filed in the United States Patent and Trademark Office on Jul. 27, 2017, the entire content of which is incorporated herein by reference.

The present application is related to U.S. patent application Ser. No. 15/808,872, filed on Jan. 9, 2017, U.S. patent application Ser. No. 15/808,877, filed on Nov. 9, 2017, U.S. patent application Ser. No. 15/808,878, filed on Nov. 9, 2017, U.S. patent application Ser. No. 15/880,466, filed on Jan. 25, 2018, and U.S. patent application Ser. No. 15/880,488, filed on Jan. 25, 2018, the entire contents of which are incorporated herein by reference.

FIELD

Aspects of embodiments of the present disclosure relate generally to composite armor and, more specifically, to three-dimensional architected composite armor.

BACKGROUND

Armor is often provided to protect vehicles, structures, and personnel on a battlefield. In its most basic form, armor includes (or consists of) simple metal sheets or plates. The ability of such armor to stop (or defeat) a projectile (e.g., bullets, missile warheads, shrapnel, etc.) is primarily based on the composition of the metal plate and the thickness thereof. However, this form of armor is limited by overall weight, which may become excessive based on the composition of the metal plate and the thickness necessary to defeat modern projectiles, and cost as more exotic metals are relatively more expensive. One variation of metal armor plate is bulk composite armor, in which different metal materials are mixed together to form a composite metal plate.

More recently, ceramic armor has been developed. Ceramic armor provides good projectile defeat characteristics while having relatively low weight. However, ceramic armor is relatively more expensive, is manufactured in relatively large, flat sheets to be economical, and suffers from poor multi-hit capability due to fracturing on impact with a projectile.

Other forms of armor include stacked layers of metal plates and ceramic plates or tiles. One form of such composite armor includes a ceramic plate stacked between two metal plates. However, this form of armor still suffers from the ceramic plates' poor multi-hit capability and the weight of the metal plates. There remains a need for relatively light-weight armor while retaining good multi-hit capability.

SUMMARY

The present disclosure is directed to various embodiments of a three-dimensional architected composite armor structure including a three-dimensional core structure and a matrix (e.g., a matrix material) throughout the core structure.

According to one embodiment of the present disclosure, a three-dimensional architected armor structure includes a core structure and a matrix. The core structure includes: a plurality of impact members; a plurality of joint members below the impact members; and a plurality of connection members respectively extending between one of the impact members and one of the joint members. The matrix fills at least a portion of a space between the impact members, the joint members, and the connection members.

One of the impact members may have a parallelepiped shape, a truncated pyramid shape, a cone shape, or a wedge shape.

One of the joint members may have a truncated pyramid shape, a cone shape, or a wedge shape.

The core structure may be arranged to have a plurality of levels stacked on each other in a first direction, and each of the levels may extend in second and third directions perpendicular to the first direction. The impact members may be in a first level from among the levels, the joint members may be in a second level and a third level from among the levels, and the connection members may extend between the first and second levels and between the second and third levels.

The connection members may extend between the first and second levels and between the second and third levels at an inclination with respect to the first direction.

An outermost surface of the impact members in the first level may be planar.

An outermost surface of the impact members in the first level may be inclined with respect to the first direction.

The core structure may include a base material, and the base material may include steel, maraging steel, titanium, aluminum, nickel, or a combination thereof.

The core structure may further include ceramic nanoparticles interspersed in at least a portion of the base material.

A concentration of the ceramic nanoparticles by volume in the base material may be greater in the impact members than it is in the joint members.

A concentration of the ceramic nanoparticles may be functionally graded throughout the core structure, and a concentration of the ceramic nanoparticles in the core structure may be greater at a first surface of the core structure than at a second surface of the core structure opposite the first surface.

The matrix may include aluminum, maraging steel, titanium, magnesium, nickel, or a combination of these materials, and a hardness of the matrix may be lower than that of the base material.

The matrix may be configured to apply compressive stress to the core structure in a range from 0.5 MPa to 5000 MPa.

According to another embodiment of the present disclosure, an architected armor structure includes a core structure and a matrix. The core structure may include a plurality of members that are spaced from each other to form a three-dimensional truss, and a hardness of the core structure at a first surface is greater than a hardness of the core structure at a second surface. The matrix fills at least a portion of open spaces in the three-dimensional truss.

The matrix may have a hardness that is less than a lowest hardness of the core structure.

The matrix may have a hardness that is greater than a lowest hardness of the core structure and less than a greatest hardness of the core structure.

The core structure may be formed by an additive manufacturing process, and the matrix may be formed by a casting process.

The core structure may include a plurality of impact members at an outermost surface thereof, a plurality of joint members arranged in a plurality of levels below the impact members, and a plurality of connection members respectively extending between one of the impact members and one of the joint members.

A hardness of the impact members at the outermost surface of the core structure may be greater than a hardness of the impact members facing the joint members.

According to another embodiment of the present disclosure, an architected armor structure includes a core structure and a matrix. The core structure has a plurality of levels stacked on each other in a first direction and includes: a plurality of impact members in a first level from among the levels, the first level including an outermost surface of the core structure; a plurality of joint members in a second level from among the levels; and a plurality of connection members extending between the first level and the second level. The matrix fills at least a portion of open spaces between adjacent ones of the impact members, adjacent ones of the joint members, and adjacent ones of the connection members. A hardness of the core structure is functionally graded in the first direction, the impact members have a greater hardness than the joint members, and the connection members have a greater hardness than the joint members and a lower hardness than the impact members.

This summary is provided to introduce a selection of features and concepts of embodiments of the present disclosure that are further described below in the detailed description. This summary is not intended to identify key or essential features of the claimed subject matter, nor is it intended to be used in limiting the scope of the claimed subject matter. One or more of the described features may be combined with one or more other described features to provide a workable device.

BRIEF DESCRIPTION OF THE DRAWINGS

Embodiments of the present disclosure are described with reference to the following figures. The same reference numerals are used throughout the figures to reference like features and components. The figures are not necessarily drawn to scale.

DETAILED DESCRIPTION

The present disclosure is directed to various embodiments of a three-dimensional architected composite armor structure including a three-dimensional core structure and a matrix (e.g., a matrix material) throughout the core structure. The core structure may be harder (e.g., may be made of a harder material or composite) than the matrix. The three-dimensional architected armor structure may have superb projectile defeating characteristics by increasing an interaction volume of the armor structure with an impacting projectile for a given weight due to the presence of the softer matrix. Accordingly, the three-dimensional architected composite armor structure may provide enhanced projectile defeat characteristics while having a relatively low weight and being relatively easy to manufacture, as will be further described below.

Figure 1:
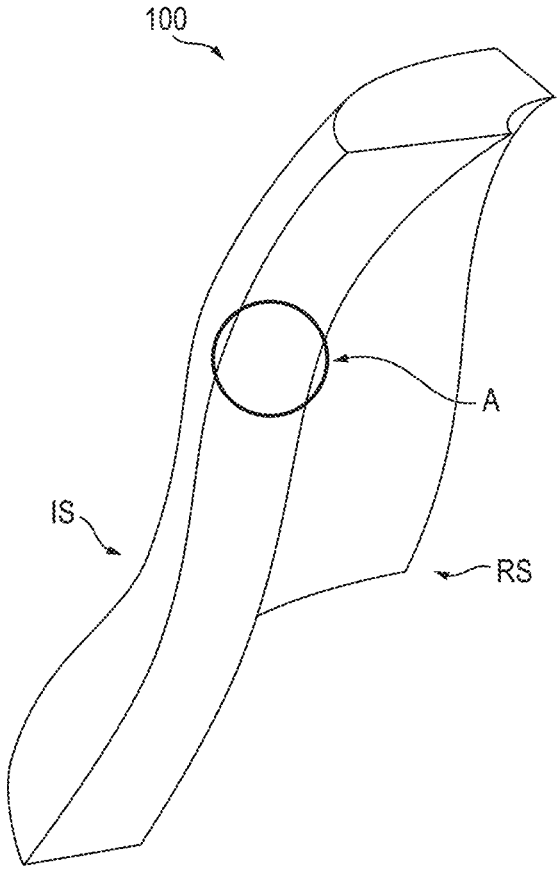
FIG. 1 is a perspective view of a cross-section of an architected armor sheet according to an embodiment of the present disclosure.

FIG. 1 is a cross-sectional view of a three-dimensional architected composite armor structure (e.g., the architected composite armor structure) 100 according to an embodiment of the present disclosure. An impact surface (e.g., an outer surface or a first surface) of the architected composite armor structure 100 is indicated by IS, and a rear surface (e.g., an inner surface or a second surface) thereof is indicated by RS. In use, the impact surface IS of the architected composite armor structure 100 faces away from the protected individual, vehicle, structure, etc.

The architected composite armor structure 100 can be formed to be flexible and/or formed to have certain or set contours. For example, thinner embodiments of the architected composite armor structure 100 may be flexible for use as personal body armor while thicker embodiments of the architected composite armor structure 100, which may be more rigid, can be used on or in connection with vehicles and structures. Because flexibility is a less important characteristics when the architected composite armor structure 100 is applied to vehicles and structures, the architected composite armor structure 100 may be formed to be thicker to improve its projectile defeat characteristics while sacrificing some flexibility. The armor structure 100 may have a thickness in a range from about 0.25 inches to about 5 inches, depending on the application.

In addition, the architected composite armor structure 100 may be formed to have a contour shape to match, for example, a user's body or a particular portion of a vehicle or structure. Further, the armor structure 100 may be covered by a cloth layer or the like for use by personnel.

The architected composite armor structure 100 includes a three-dimensional core structure 200 (see, e.g., FIGS. 2-4) and a matrix 300 (e.g., a matrix material) (see, e.g., FIG. 5) throughout the core structure 200 (e.g., the matrix 300 may fill at least a portion of open spaces throughout the core structure 200). The core structure 200 may have a three-dimensional truss structure (e.g., a space frame truss structure), and the matrix 300 is formed throughout the open spaces of the three-dimensional truss structure (e.g., the matrix may fill at least a portion of each or a portion of the open spaces). For example, the matrix 300 may fill voids in the core structure 200 such that the core structure 200 and the matrix 300 together form a substantially unitary architected composite armor structure 100.

The core structure 200 may include steel, maraging steel, titanium, aluminum, nickel, or a combination of any of these materials. As used herein, the terms "combination thereof" and "combinations thereof" may refer to a chemical combination (e.g., an alloy or chemical compound), a mixture, or a layered structure of components. However, the core structure 200 is not limited to the foregoing materials and may include any suitable material as would be understood by one skilled in the art. In addition, the core structure 200 may further include nanoparticles interspersed therein to selectively increase the hardness of the core structure 200. The hardness of the core structure 200 and the matrix 300 may be measured by, as one example, the Rockwell scale. For example, the core structure 200 including the nanoparticles may be a metal matrix nanocomposite (MMNC). The nanoparticles may include, for example, hard ceramic nanoparticles, such as tungsten carbide (WC) nanoparticles. The amount of the nanoparticles arranged in the core structure 200 (e.g., a concentration of the nanoparticles in the core structure 200) may be selectively controlled, as will be further described below. In some embodiments, the core structure 200 may omit the nanoparticles altogether.

The matrix 300 may include aluminum, maraging steel, titanium, magnesium, nickel, or a combination of any of these materials. In one embodiment, the matrix 300 may include a cast aluminum-silicon (Al—Si) alloy. However, the matrix 300 is not limited to these materials and may include any suitable material as would be understood by one skilled in the art. In addition, the matrix 300 may further include the nanoparticles therein to selectively increase the hardness of the matrix 300. The nanoparticles may include, for example, hard ceramic nanoparticles, such as tungsten carbide (WC) nanoparticles. The amount of the nanoparticles arranged in the matrix 300 may be selectively controlled, as will be further described below. In some embodiments, the matrix 300 may omit the nanoparticles altogether.

Figure 2:
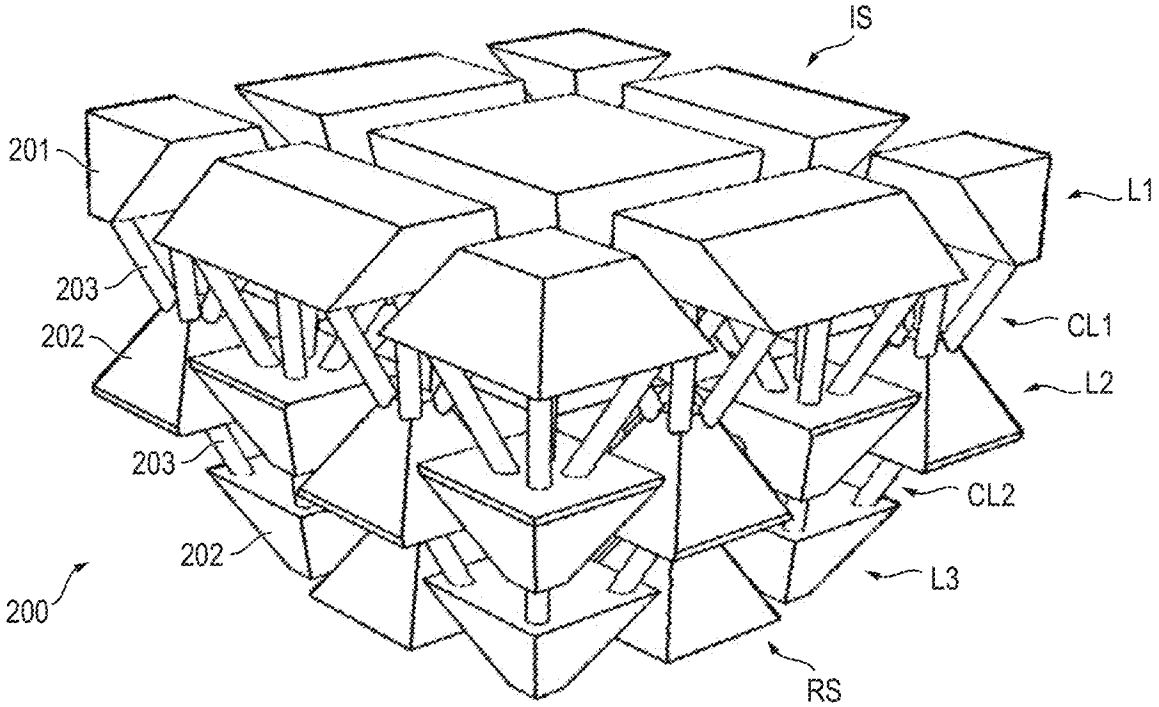
FIG. 2 is a close-up, top-side perspective view of the portion A of FIG. 1 without a matrix.
Figure 3:
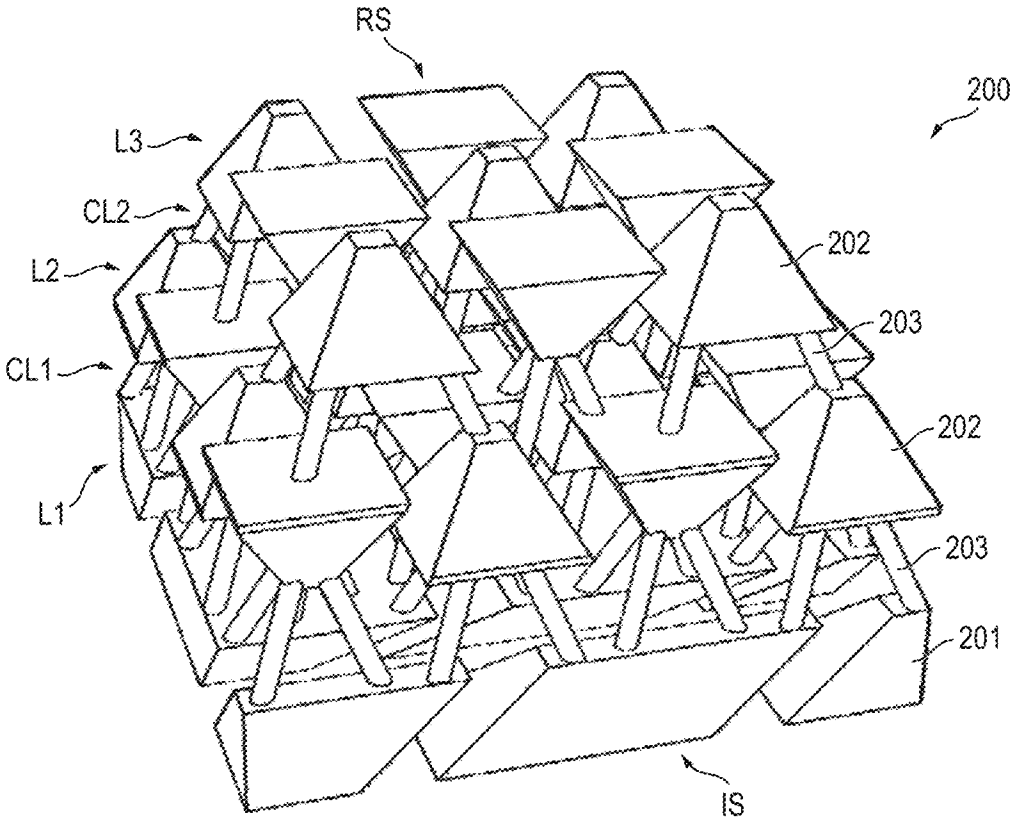
FIG. 3 is a close-up, bottom-side perspective view of the portion A of FIG. 1 without the matrix.
Figure 4:
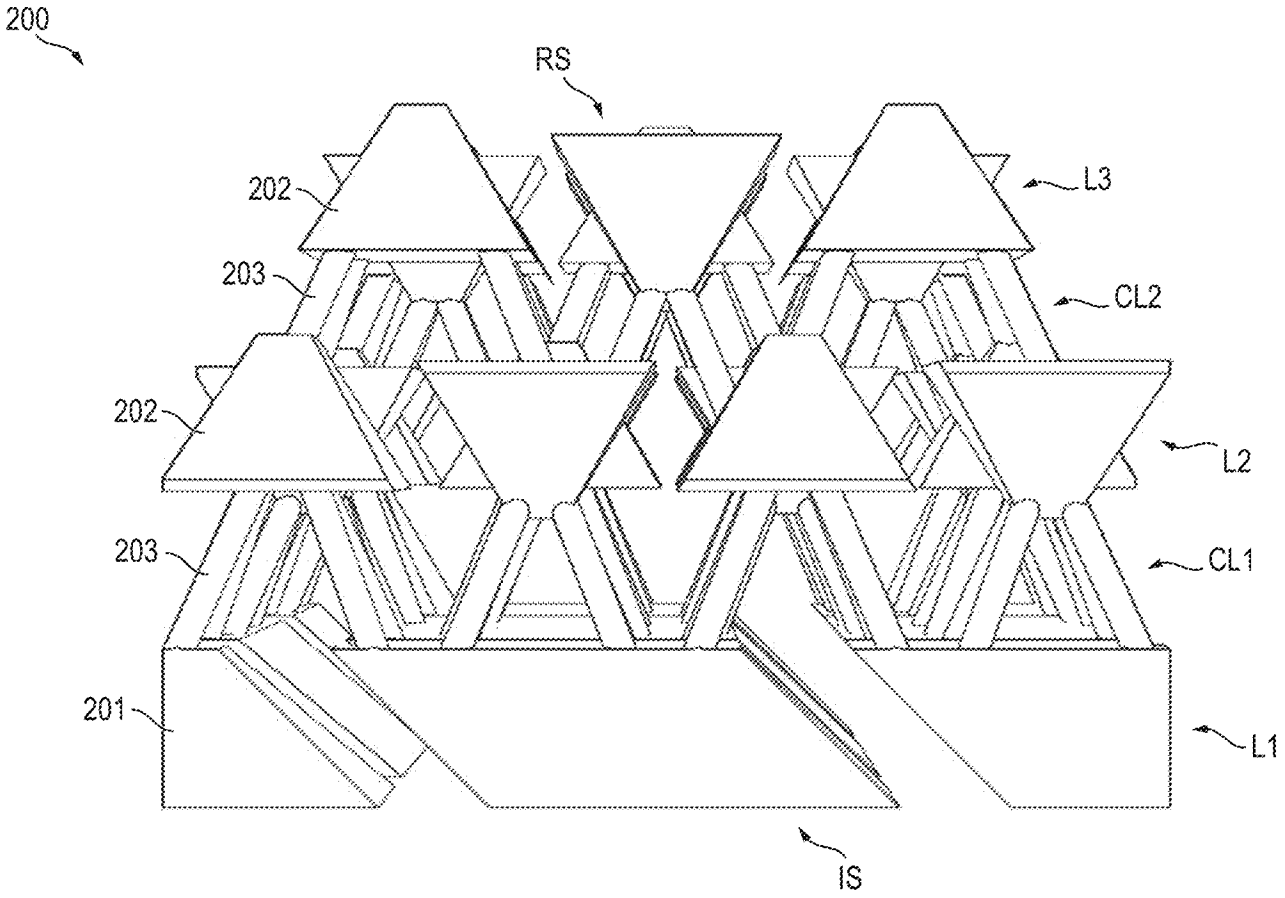
FIG. 4 is a side view of the portion A of FIG. 1 without the matrix.
Figure 5:
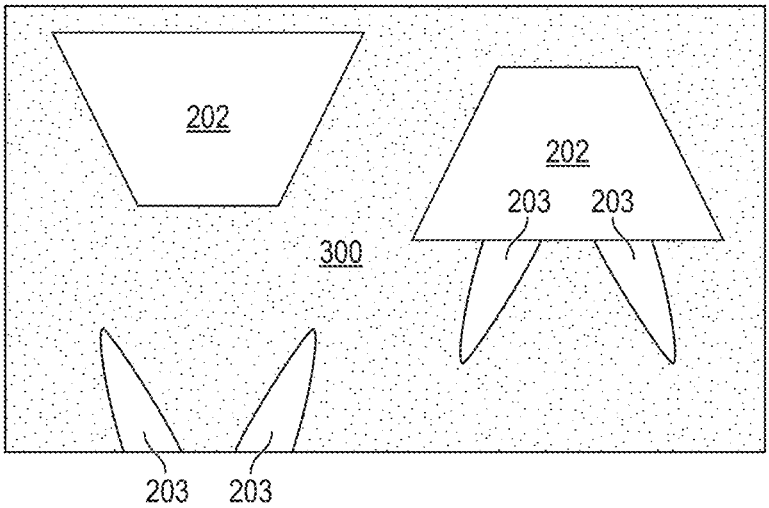
FIG. 5 is a side, cross-sectional view of the portion A of FIG. 1 with the matrix.

FIGS. 2-4 are close-up views of the portion A of FIG. 1 without the matrix 300 to more clearly illustrate the core structure 200, and FIG. 5 is a side, cross-sectional view of the portion A of FIG. 1 with the matrix 300. The core structure 200 may have a plurality of levels L1-L3. The composition and/or arrangement of the levels L1-L3 may be substantially the same or different with respect to one another. In FIGS. 2-4, only three levels are shown for ease of explanation. However, the present disclosure is not limited to any particular number of levels, and the number of levels may be selected based on an intended application of a particular armor system. For example, an armor system to be applied to a structure may have more levels for increased protection at the cost of additional weight and reduced flexibility relative to an armor system to be used by personnel, which may have fewer levels for reduced weight and increased flexibility at the cost of reduced protection.

The first level L1 forms the impact surface IS of the core structure 200 (e.g., is adjacent the impact surface IS of the architected composite armor structure 100 and faces away from a structure, vehicle, or personnel to be protected). The second and third levels L2 and L3 are also illustrated, and as will be described further below, joint members 202 that form the second and third levels L2 and L3 may have different shapes than impact members 201 that form the first level L1.

As can be seen at least in FIGS. 2 and 4, a plurality of impact members 201 are arranged adjacent each other to form the first level L1 and the impact surface IS. Outermost surfaces of the impact members 201, as shown in FIGS. 2 and 4, are flat or substantially flat to form an impact surface for an incoming projectile. The impact surface IS may further act to break up an incoming projectile. For example, the outermost surfaces of the impact members 201 (e.g., the surfaces facing away from the structure, vehicle, or personnel to be protected) are relatively large and relatively flat to meet an incoming projectile and absorb the projectile's energy, which is then passed onto the lower levels L2, L3, etc. and to the matrix 300. However, the present disclosure is not limited thereto, and the impact surfaces of the impact members 201 may be curved, canted, pointed, or have any other suitable shape for deflecting and/or directing an impacting projectile. For example, when the impact surfaces of the impact members 201 are inclined in a direction in which the first-third levels L1-L3 are stacked on each other (e.g., a first direction), there is an increased chance that an impacting projectile may glance off of the impact surface IS, greatly reducing the energy imparted to the armor structure 100. Further, the impact members 201 may be harder than the matrix 300 and harder than the joint members 202 of the second and third levels L2 and L3 of the core structure 200, and in some embodiments, the impact surface of the impact members 201 may be the hardest surface of the impact members 201 when the hardness of the impact members 201 is spatially graded (or functionally graded), further discussed below.

Further, different ones of the impact members 201 may have different shapes, and the impact members 201 may be arranged in a repeating or non-repeating pattern. For example, in FIG. 2, ones of the impact members 201 have a truncated pyramid shape, a reverse truncated pyramid shape, and various parallelepiped shapes. In one embodiment, the impact members 201 in the lower levels L2 and L3 of the core structure 200 are arranged in a two-dimensional A-B repeating pattern in which impact members 201 having the truncated pyramid shape and the reverse truncated pyramid shape are arranged adjacent each other.

As can be seen in FIGS. 2-4, the impact members 201 having the parallelepiped shapes may have flat or substantially flat surfaces facing in the first direction and may have inclined surfaces facing other directions. However, the present disclosure is not limited thereto, and the impact members 201 may have any suitable shape and position that provides energy transfer to the matrix 300. For example, the truncated pyramid shaped impact members 201, the reverse truncated pyramid shaped impact members 201, and the parallelepiped shaped impact members 201 each have a relatively large, relatively flat bottom or rear surface that acts to transfer energy from the impact surface of the impact members 201 to the matrix 300 and to the joint members 202 at the second and third levels L2 and L3 via connection members 203, further discussed below.

FIG. 2 shows one example of a repeating pattern of the impact members 201, including one reverse truncated pyramid shaped impact member 201 at a center of the pattern, four parallelepiped shaped impact members 201 adjacent the four edges of the reverse truncated pyramid shaped impact member 201, and four truncated pyramid shaped impact members 201 adjacent the four corners of the reverse truncated pyramid shaped impact member 201, thus forming one repeating unit of the impact surface IS (e.g., forming one repeating unit of the first level L1). However, the present disclosure is not limited thereto, and other patterns of the impact members 201 having various suitable shapes may be used. Further, the impact members 201 may have a length, width, and/or height in a range from about 0.5 mm to about 20 mm, but the present disclosure is not limited thereto.

A distance between adjacent ones of the levels L1-L3 may be in a range of about 0.5 mm to about 5 mm or larger. In one embodiment, the levels L1-L3 may each be about 2 mm apart from each other. In some embodiments, the spacing between the various adjacent levels L1-L3 may vary. For example, a distance between the third level L3 and the second level L3 may be about 2 mm, and a distance between the second level L2 and the first level L1 may be about 4 mm, or vice versa. The connection members 203, further discussed below, will be longer between levels that are spaced farther apart and shorter between levels that are nearer to each other.

As can be seen in FIGS. 2-4, a plurality of joint members 202 are arranged at the second and third levels L2 and L3 of the core structure 200. In the illustrated embodiment, the joint members 202 have either a truncated pyramid shape or a reverse truncated pyramid shape. However, the present disclosure is not limited thereto, and the joint members 202 may have any suitable shape and position that provides energy transfer to the matrix 300, such as cone shapes (e.g., a cone shape or a frustoconical shape) or wedge shapes. For example, the truncated pyramid shaped joint members 202 have at least one relatively large, relatively flat surface that acts to transfer energy from the projectile and the impact members 201 to the matrix 300 and to other, lower levels of the joint members 202 via the connection members 203. In FIGS. 2-4, each of the second and third levels L2 and L3 includes a repeating pattern of truncated pyramid shaped joint members 202 and reverse truncated pyramid shaped joint members 202, which together efficiently reduce open spaces between the adjacent joint members 202 where the matrix 300 is filled. However, the present disclosure is not limited thereto, and the joint members 202 may be arranged in different patterns or may be randomly arranged. Further, the joint members 202 may have a length, width, and/or height in a range from about 0.5 mm to about 20 mm, but the present disclosure is not limited thereto.

Connection levels CL1 and CL2 are respectively arranged between the first and second levels L1 and L2 and between the second and third levels L2 and L3. A plurality of connection members 203 are arranged in each of the first and second connection levels CL1 and CL2. The connection members 203 in the first connection level CL1 extend between and connect the impact members 201 in the first level L1 and the joint members 202 in the second level L2. Similarly, the connection members 203 in the second connection level L2 extend between and connect the joint members 202 in the second level L2 and the joint members 202 in the third level L3. The connection members 203 can be considered the trusses in the space frame truss core structure 200.

The connection members 203 in the illustrated embodiment are cylindrical (e.g., have a circular cross-sectional shape) and may have a diameter of about 0.5 mm, but the present disclosure is not limited thereto. In some embodiments, the connection members 203 may have other suitable shapes, such as a rectangular cross-sectional shape or an oblong cross-sectional shape. Further, the connection members 203 may have a length in a range from about 0.5 mm to about 20 mm, but the present disclosure is not limited thereto.

The connection members 203 extend at an angle with respect to surfaces of the impact members 201 and the joint members 202 from which they extend. For example, if the direction between the first-third levels L1-L3 (e.g., the direction in which the first-third levels L1-L3 are stacked on each other) is the first direction and the first-third levels L1-L3 are each arranged on a plane formed by second and third directions normal to the first direction, the connection members 203 extend at an incline with respect to the first direction. For example, an angle between the connection members 203 and the first direction may be in a range between about 10° and about 45°. However, the present disclosure is not limited thereto, and in some embodiments, the connection members 203 may extend parallel to the first direction.

As can be seen in FIG. 2, the ends (e.g., the upper ends) of the joint members 202 in the second level L2 facing the impact members 201 in the first level L1 may be connected to four connection members 203 extending from the impact members 201. For example, truncated top ends of the joint members 202 in the second level L2 may be connected to four connection members 203 respectively extending from where the edges (e.g., the four edges) at where faces (e.g., inclined faces) of the joint members 202 meet each other. For example, as can be seen in FIG. 2, the connection members 203 may meet (or extend from) the joint members 202 at the edges where the adjacent faces of the joint members 202 meet each other. Further, the flat or substantially flat bottom surfaces of the joint members 202 in the second level L2 facing the impact members 201 in the first level L1 may also be connected to four connection members 203. For example, the four connection members 203 contacting the flat surface of the joint members 202 may be arranged around a central portion of the flat surface (e.g., the connection members 203 may be angled toward the central portion of the flat surface of the joint member 202 to which they connect). Thus, each of the joint members 202 in the second level L2 may be connected to the impact members 201 in the first level L1 by four connection members 203. However, the present disclosure is not limited thereto, and the number of the connection members 203 between the impact members 201 in the first level L1 and the joint members 202 in the second level L2 may vary.

Further, as can be seen in FIG. 3, the ends of some of the joint members 202 in the second level L2 facing the joint members 202 in the third level L3 may be connected to one connection member 203 extending to the joint members 202 in the third level L3. However, some of the joint members 202 in the second level L2 may be connected to the joint members 202 in the third level L3 by a plurality of connection members 203, such as two connection members 203. The connection members 203 extending between the joint members 202 in the second and third layers L2 and L3 may extend from a central portion of the lower surfaces (e.g., the bottom ends) of the joint members 202 in the second level L2.

As can be seen in FIG. 4, the connection members 203 may be arranged in rows when viewed in a direction parallel to first and second connection levels L1 and L2. For example, the connection members 203 extending between the impact members 201 in the first level L1 and the joint members 202 in the second level L2 may be arranged in a first connection layer CL1, and the connection members 203 extending between the joint members 202 in the second level L2 and the joint members 202 in the third level L3 may be arranged in a second connection layer CL2. The connection members 203 in the first and second connection layers CL1 and CL2 may be aligned with each other in rows along the second and/or the third direction, as described above.

The connection members 203 act to transfer energy (e.g., energy from an impacting projectile) from the impact members 201 to the joint members 202 at lower levels, each of which transfer and distribute the energy to the matrix 300 and/or to lower levels of the core structure 200 (e.g., to the first and second connection levels CL1 and CL2 and the second and third levels L2 and L3). Thus, at each level L1-L3, the energy is dissipated over a larger area of the core structure 200 and to a greater amount of the matrix 300, thereby providing superior protection when compared to conventional plate armor, such as homogenous plate armor.

The core structure 200 may be formed (or manufactured) by using an additive manufacturing process, such as three-dimensional printing, in which a three-dimensional object is formed by adding layer-upon-layer of material. However, the present disclosure is not limited thereto, and in some embodiments, the core structure may be formed by casting. By using these processes, the core structure 200 may be formed (e.g., printed or cast) as a single, continuous structure, thereby reducing the likelihood of a weak point occurring or forming at a location where the connection members 203 meet the impact members 201 and/or the joint members 202.

Furthermore, during the process of forming the core structure 200, the hardness of the various levels L1-L3, CL1, and CL2 of the core structure 200 can be selectively or functionally controlled or graded. That is, the hardness of the core structure 200 may be functionally graded (e.g., the hardness of the core structure 200 may vary gradually by volume). For example, the core structure 200 may be a functionally graded metal matrix nanocomposite or cermet. The functional gradation of the hardness of the core structure 200 provides spatial gradients in the hardness of the core structure 200 to improve energy transfer and distribution from an impacting projectile. For example, the impact surface IS of the core structure 200 (e.g., the impact surface of the impact members 201) may be harder than the other members (e.g. the impact members 202 at the second and third levels L2 and L3) of the core structure 200. In some embodiments, the hardness of the impact members 201 may vary within the impact members 201 (e.g., the impact members 201 may have graded through-thickness hardness variation), such that the impact surface of the impact members 201 is harder than the bottom or rear surface thereof. However, in some embodiments, the hardness may vary by level, with the impact members 201 at the first level L1 being harder than the joint members 202 at the second level L2, and the joint members 202 at the second level L2 being harder than the joint members 202 at the third level L3.

The functional gradation of the hardness of the core structure 200 may be controlled by, for example, selective inclusion of the hard ceramic nanoparticles, such as tungsten carbide (WC) nanoparticles, in a material (e.g., a metal material, as described above) of the core structure 200. The hard ceramic nanoparticles may be included in the material of the core structure 200 by any suitable method as would be understood by those skilled in the relevant art. For example, the first level L1 of the core structure 200 may include more hard ceramic nanoparticles than the second and third levels L2 and L3 thereof. The functional gradation of the hardness of the core structure 200 may vary in a range from about 5% to about 500%. In some embodiments, the hard ceramic nanoparticles may be selectively included in the core structure by using any suitable casting method. For example, suitable casting methods include centrifugal casting, gravity casting, electromagnetic separation casing. In some embodiments, the hard ceramic nanoparticles may be selectively included in the core structure by using a mixed powder solidification control method.

As further examples, when using the additive manufacturing method to form the core structure 200, the amount (e.g., the concentration) of hard ceramic nanoparticles included in the material to form the core structure 200 by volume may be selectively varied down to a single layer of material, providing a relatively high level of control of the functional gradation of the hardness of the core structure 200. Similarly, when the casting method is used form the core structure 200, the amount of hard ceramic nanoparticles included in the material to form the core structure 200 by volume may be selectively varied. However, the amount of the hard ceramic nanoparticles in the material forming the core structure 200 may be less finely controlled in the casting method than in the additive manufacturing method.

After the core structure 200 is formed, the matrix 300 is formed around the core structure 200. For example, the material forming the matrix 300 is cast around the core structure 200. As the material cools and solidifies, it undergoes solidification shrinkage and thermal contraction, which applies compressive stress to the core structure 200, further improving the overall strength of the armor structure 100. The compressive stress applied to the core structure 200 by the matrix 300 may be in a range from about 0.5 MPa to about 5000 MPa, but the present disclosure is not limited thereto.

In some embodiments, the matrix 300 may have a functionally graded hardness. For example, in some embodiments, both the core structure 200 and the matrix 300 may have a functionally graded hardness, in some embodiments only the core structure 200 may have a functionally graded hardness, and in some embodiments only the matrix 300 may have a functionally graded hardness. The hardness of the matrix 300 may be functionally graded similar to how the hardness of the core structure 200 is functionally graded. For example, the matrix 300 may selectively include hard ceramic nanoparticles to increase a hardness thereof, and an amount of the hard ceramic nanoparticles included in the matrix 300 may increase from the rear surface RS of the armor structure 100 to the impact surface IS thereof.

The matrix 300 may extend above the impact surface of the impact members 201, an upper surface of the matrix 300 may be substantially flush or level with the impact surface of the impact members 201, or at least a portion of the impact members 201 may protrude from the matrix 300. Similarly, the matrix 300 may extend below a bottom or rear surface of the joint members 202 at the bottommost level of the core structure 200 (e.g., the third level L3 in the illustrated embodiment), the matrix 300 may have a lower surface that is flush or level with the rear or bottom surface of the joint members 202 at the bottommost level of the core structure 200, or at least a portion of the joint members 202 may protrude from the matrix 300.

In the armor structure 100, the core structure 200 may be considered the hard phase which acts to disrupt, destroy, or deflect incoming projectiles and then transfers energy from the projectiles to the matrix 300, which may be considered the soft phase and acts to spread and accumulate the energy rather than transmitting the energy directly though the armor structure 100.

Figure 6A:
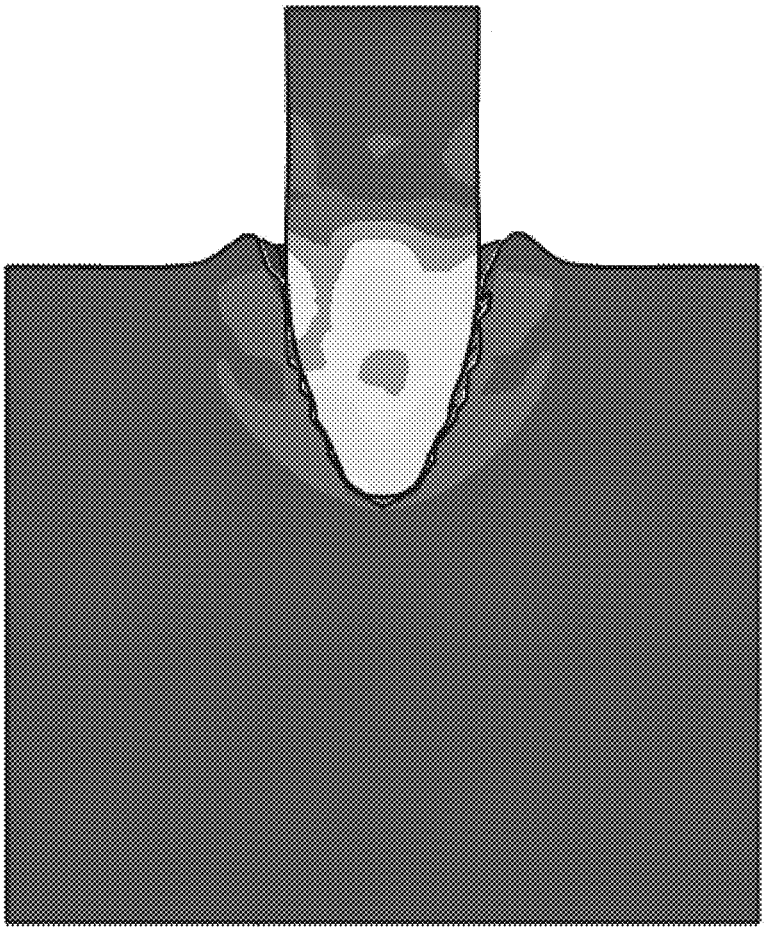
FIGS. 6A-6C are images of a finite element analysis (FEA) simulation of a projectile impacting a comparative aluminum armor plate.
Figure 6B:
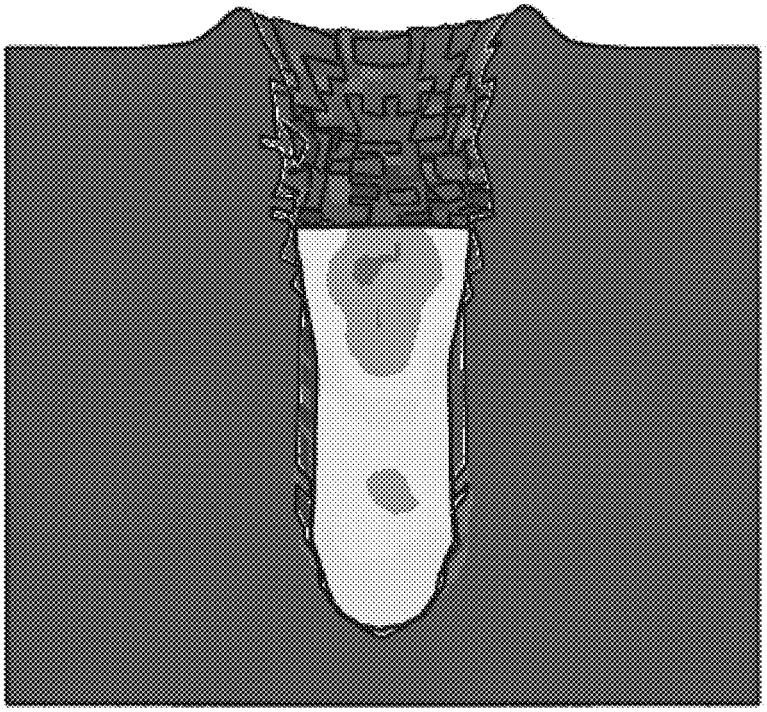
Figure 6C:
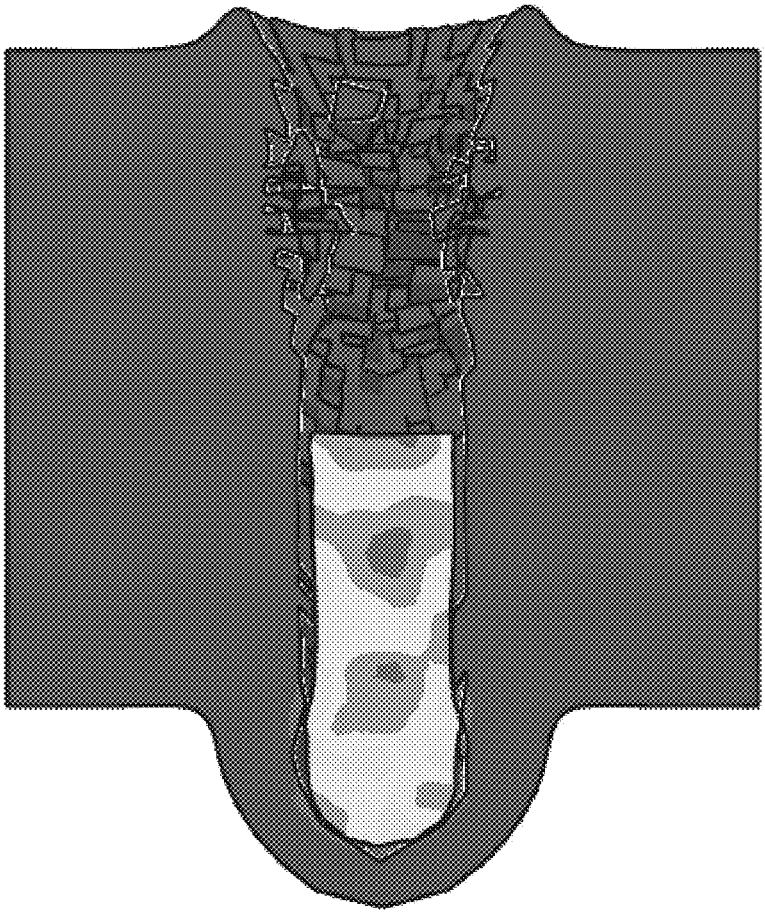
Figure 7A:
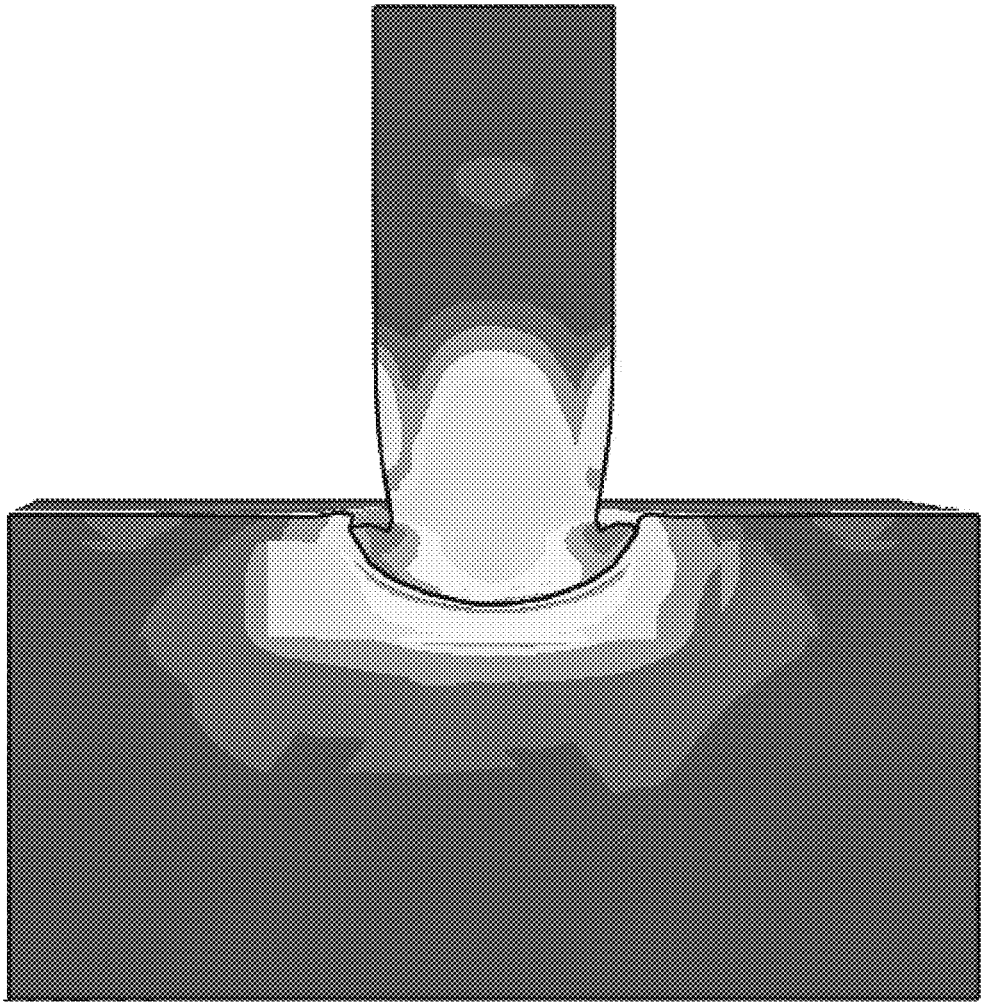
FIG. 7A-7C are images of an FEA simulation of a projectile impacting an architected armor sheet according to an embodiment of the present disclosure.
Figure 7B:
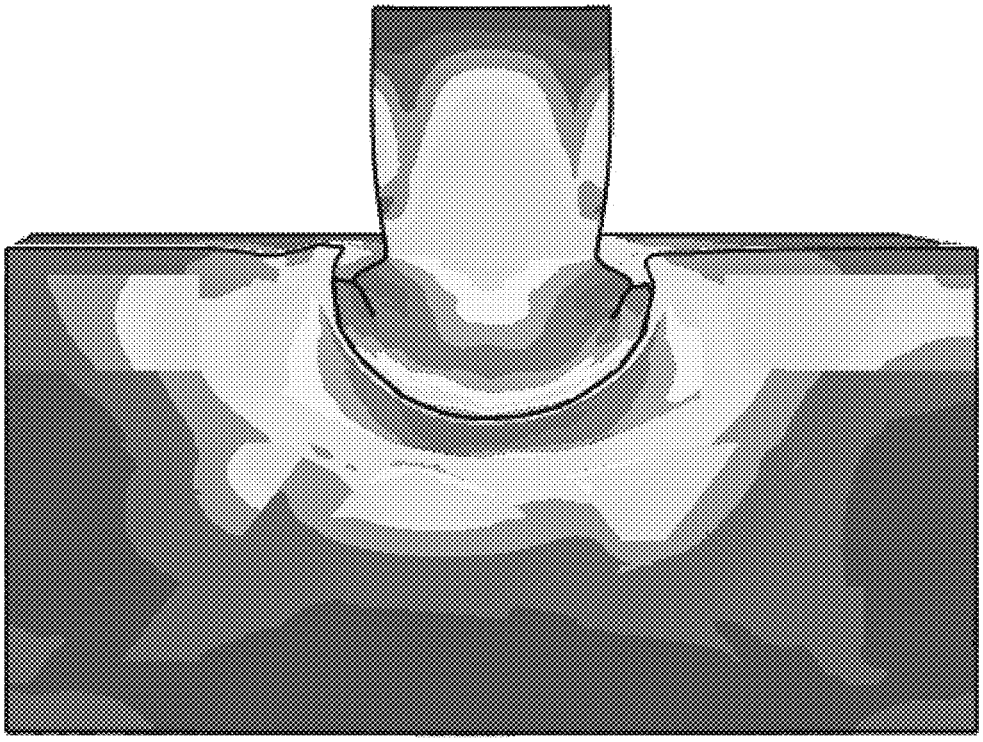
Figure 7C:
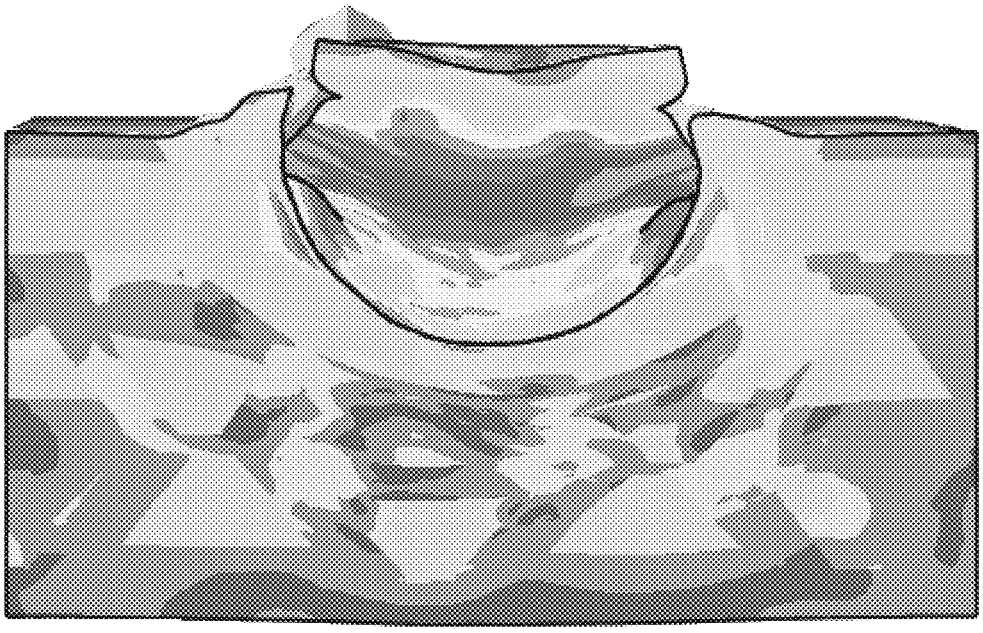

FIGS. 6A-6C are images of a finite element analysis (FEA) simulation of a projectile impacting a comparative aluminum armor plate, and FIG. 7A-7C are images of an FEA simulation of a projectile impacting an architected armor sheet according to an embodiment of the present disclosure. The aluminum armor plate shown in FIGS. 6A-6C has substantially the same or the same areal density as the architected armor sheet shown in FIGS. 7A-7C. In FIGS. 6A-7C, lighter colors indicate higher plastic strain than darker colors.

As can be seen in FIGS. 6A-6C, the projectile proceeds through the aluminum plate without being substantially deformed. Further, the energy from the projectile is focused at a relatively small area of the aluminum armor plate and is not spread out over the other areas of the aluminum armor plate. Further, a substantial amount of the energy is transferred to the rear surface of the aluminum armor plate, such that the rear surfaces bulges outwardly. This energy would then be transferred to the structure, vehicle, or personnel to be protected, resulting in damage thereto.

However, as can be seen in FIGS. 7A-7C, the projectile is effectively stopped by the architected armor sheet according to an embodiment of the present disclosure, and the energy is effectively distributed over a relatively large area of the architected armor sheet, unlike the aluminum armor plate. Further, very little energy is transmitted through the architected armor sheet to the rear surface thereof, thereby effectively protecting the underlying structure, vehicle, or personnel. Thus, as can be seen, the architected armor sheet according to an embodiment of the present disclosure provides more effective protection than a conventional aluminum armor plate having the same areal density.

Testing using a 7.62×30-mm steel projectile traveling at 1,000 m/s has shown that the architected armor sheet according to an embodiment of the present disclosure provides greater than a 1.5× increase in V50 performance compared to conventional aluminum plate armor having the same or substantially similar areal densities. The V50 ballistic test is a U.S. Department of Defense standardized test procedure used to test ballistic impact performance of armor systems.

It will be understood that when an element or layer is referred to as being "on" or "connected to" another element or layer, it may be directly on or connected to the other element or layer or one or more intervening elements or layers may also be present. When an element or layer is referred to as being "directly on" or "directly connected to" another element or layer, there are no intervening elements or layers present. For example, when a first element is described as being "connected" to a second element, the first element may be directly connected to the second element or the first element may be indirectly connected to the second element via one or more intervening elements.

The terminology used herein is for the purpose of describing particular example embodiments of the present disclosure and is not intended to be limiting of the described example embodiments of the present disclosure. As used herein, the singular forms "one," "a," and "an" may include the plural forms as well, unless the context clearly indicates otherwise. It will be further understood that the terms "includes," "including," "comprises," and/or "comprising," when used in this specification, specify the presence of stated features, integers, steps, operations, elements, and/or components but do not preclude the presence or addition of one or more other features, integers, steps, operations, elements, components, and/or groups thereof. As used herein, the term "and/or" includes any and all combinations of one or more of the associated listed items. Further, the use of "may" when describing embodiments of the present disclosure relates to "one or more embodiments of the present disclosure." As used herein, the terms "use," "using," and "used" may be considered synonymous with the terms "utilize," "utilizing," and "utilized," respectively.

It will be understood that, although the terms first, second, third, etc. may be used herein to describe various elements, components, regions, layers, and/or levels, these elements, components, regions, layers, and/or levels should not be limited by these terms. These terms are used to distinguish one element, component, region, layer, or level from another element, component, region, layer, or level. Thus, a first element, component, region, layer, or level discussed below could be termed a second element, component, region, layer, or level without departing from the teachings of example embodiments. In the figures, dimensions of the various elements, layers, etc. may be exaggerated for clarity of illustration.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" or "over" the other elements or features. Thus, the term "below" may encompass both an orientation of above and below. The device may be otherwise oriented (rotated 90 degrees or at other orientations), and the spatially relative descriptors used herein should be interpreted accordingly.

Also, any numerical range disclosed and/or recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein, and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein.

What is claimed is:

1. A three-dimensional architected armor structure comprising:

a core structure comprising:

a plurality of impact members, the impact members being spaced apart from each other;

a plurality of joint members below the impact members; and a plurality of connection members respectively extending between one of the impact members and one of the joint members, a first group of the connection members extending from a first one of the impact members, a second group of the connection members extending from a second one of the impact members; and a matrix filling at least a portion of a space between the impact members, the joint members, and the connection members.

2. The three-dimensional architected armor structure of claim 1, wherein one of the impact members has a parallelepiped shape, a truncated pyramid shape, a cone shape, or a wedge shape.

3. The three-dimensional architected armor structure of claim 2, wherein one of the joint members has a truncated pyramid shape, a cone shape, or a wedge shape.

4. The three-dimensional architected armor structure of claim 1, wherein the core structure is arranged to have a plurality of levels stacked on each other in a first direction, each of the levels extending in second and third directions perpendicular to the first direction, wherein the impact members are in a first level from among the levels, wherein the joint members are in a second level and a third level from among the levels, and wherein the connection members extend between the first and second levels and between the second and third levels.

5. The three-dimensional architected armor structure of claim 4, wherein the connection members extend between the first and second levels and between the second and third levels at an inclination with respect to the first direction.

6. The three-dimensional architected armor structure of claim 4, wherein an outermost surface of the impact members in the first level is planar.

7. The three-dimensional architected armor structure of claim 4, wherein an outermost surface of the impact members in the first level is inclined with respect to the first direction.

8. The three-dimensional architected armor structure of claim 1, wherein the core structure comprises steel, maraging steel, titanium, aluminum, nickel, or a combination thereof.

9. The three-dimensional architected armor structure of claim 8, wherein the core structure further comprises ceramic nanoparticles interspersed in the core structure.

10. The three-dimensional architected armor structure of claim 9, wherein a concentration of the ceramic nanoparticles by volume in the core structure is greater in the impact members than it is in the joint members.

11. The three-dimensional architected armor structure of claim 10, wherein a concentration of the ceramic nanoparticles is functionally graded throughout the core structure, and wherein a concentration of the ceramic nanoparticles in the core structure is greater at a first surface of the core structure than at a second surface of the core structure opposite the first surface.

12. The three-dimensional architected armor structure of claim 8, wherein the matrix comprises aluminum, maraging steel, titanium, magnesium, nickel, or a combination of these materials, and wherein a hardness of the matrix is lower than that of the core structure.

13. The three-dimensional architected armor structure of claim 12, wherein the matrix is configured to apply compressive stress to the core structure in a range from 0.5 MPa to 5000 MPa.

14. An architected armor structure comprising:

a core structure having a plurality of levels stacked on each other in a first direction, the core structure comprising:

a plurality of impact members in a first level from among the levels, the first level comprising an outermost surface of the core structure, the impact members in the first level being spaced apart from each other with a gap therebetween;

a plurality of joint members in a second level from among the levels; and a plurality of connection members extending between the first level and the second level; and a matrix filling at least a portion of open spaces between adjacent ones of the impact members, adjacent ones of the joint members, and adjacent ones of the connection members, wherein a hardness of the core structure is functionally graded in the first direction, the impact members have a greater hardness than the joint members, and the connection members have a greater hardness than the joint members and a lower hardness than the impact members.

15. The architected armor structure of claim 14, wherein a hardness of a first surface of the core structure is greater than a hardness of a second surface of the core structure, the second surface being opposite to the first surface.

16. The architected armor structure of claim 14, wherein the matrix has a hardness that is less than a lowest hardness of the core structure.

17. The architected armor structure of claim 16, wherein the matrix has a hardness that is greater than a lowest hardness of the core structure and less than a greatest hardness of the core structure.

18. The architected armor structure of claim 14, wherein the core structure is formed by an additive manufacturing process, and the matrix is formed by a casting process.

19. The architected armor structure of claim 14, wherein a hardness of the impact members at the outermost surface of the core structure is greater than a hardness of the impact members facing the joint members.

* * * * *